US006971482B2

(12) United States Patent
Takeda

(10) Patent No.: US 6,971,482 B2
(45) Date of Patent: Dec. 6, 2005

(54) ELEVATOR CONTROL DEVICE

(75) Inventor: Yasuaki Takeda, Tokyo-To (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 230 days.

(21) Appl. No.: 10/472,760

(22) PCT Filed: Apr. 4, 2002

(86) PCT No.: PCT/JP02/03402

§ 371 (c)(1),
(2), (4) Date: Oct. 3, 2003

(87) PCT Pub. No.: WO02/081352

PCT Pub. Date: Oct. 17, 2002

(65) Prior Publication Data

US 2004/0094367 A1 May 20, 2004

(30) Foreign Application Priority Data

Apr. 4, 2001 (JP) ..... 2001-105975

(51) Int. Cl.[7] ..... B66B 13/02
(52) U.S. Cl. ..... 187/313; 187/290; 187/296
(58) Field of Search ..... 187/247, 248, 187/313, 288–293, 296; 318/798–815, 606, 318/607, 105, 107; 307/48, 64, 66

(56) References Cited

U.S. PATENT DOCUMENTS

| | | | | |
|---|---|---|---|---|
| 3,961,688 A * | 6/1976 | Maynard | 187/289 |
| 4,349,772 A * | 9/1982 | Weiss | 318/799 |
| 4,399,892 A * | 8/1983 | Watanabe | 187/290 |
| 4,548,299 A * | 10/1985 | Nomura | 187/290 |
| 4,666,020 A * | 5/1987 | Watanabe | 187/290 |
| 5,130,617 A * | 7/1992 | Oshima et al. | 318/34 |
| 5,162,623 A * | 11/1992 | Tachino | 187/290 |
| 5,285,029 A * | 2/1994 | Araki | 187/290 |
| 5,389,749 A * | 2/1995 | Hokari et al. | 187/293 |
| 6,732,838 B1 * | 5/2004 | Okada et al. | 187/290 |

FOREIGN PATENT DOCUMENTS

| | | |
|---|---|---|
| JP | 7-33342 | 2/1995 |
| JP | 07-129251 | 5/1995 |
| JP | 11-258076 | 9/1999 |
| JP | 11-299277 | 10/1999 |
| JP | 2001-86794 | 3/2001 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

When there is a breakdown in either one of first and second power converters supplying electrical power to a multi-winding motor comprising a wind-up mechanism, a rescue operation can be safely and reliably carried out by using the remaining power converter. A wind-up mechanism comprises a two-winding motor having first and second windings, and, during normal operation, power is supplied to the first and second windings from first and second inverters respectively. When the first inverter has broken down due to excessive current, first and second contactors are switched off, and a third contactor comprising a short-circuiting unit is switched on. Consequently, both windings receive power from the second inverter, enabling the rescue operation to be carried out without causing vibrations.

5 Claims, 10 Drawing Sheets

ELEVATOR CONTROL DEVICE

BACKGROUND OF THE INVENTION

1. Field of the Invention

The present invention relates to an elevator control device, and more particularly relates to the elevator control device in a control system of a large-capacity elevator which uses a plurality of power converters to drive a wind-up mechanism, comprising a multi-winding motor, the elevator control device having a function for carrying out a rescue operation when a power converter of one system has broken down.

2. Description of the Related Art

With the proliferation of high-rise buildings in recent years, super-high-speed elevators which convey a large capacity of passengers, and double-deck elevators comprising top and bottom carriages which can convey passengers equivalent to two carriages, have gradually become commonly used. A large-capacity multi-winding motor is used to drive this type of elevator. In an elevator control device using such a multi-winding motor, the motor is driven by a plurality of connected power converters, each comprising an inverter device and a converter device.

FIG. 9 shows the constitution of this type of conventional elevator control device. In the constitution of FIG. 9, converters 2*a* and 2*b* are connected in parallel to power 1 via contactors 10*a* and 10*d*. An inverter 3*a* connects to the converter 2*a*, and a capacitor 4*a* is connected between the converter 2*a* and the inverter 3*a* (this constitutes system A); an inverter 3*b* connects to the converter 2*b*, and a capacitor 4*b* is connected between the converter 2*b* and the inverter 3*b* (this constitutes system B). The converter 2*a* and the inverter 3*a* form a first power converter, and the converter 2*b* and the inverter 3*b* form a second power converter.

When the motor of the wind-up mechanism 6 is, for example, a two-winding motor, the inverter 3*a* is connected via the contactor 10*a* to the first winding, and the inverter 3*b* is connected via the contactor 10*b* to the second winding.

A main rope 9 is hung over the wind-up mechanism 6, enabling it to lift a carriage 8. The carriage 8 and a counterweight 7 are connected by a compensation rope 13 via a compensation sheave 14.

Current detectors 12*c* and 12*d* are provided on the input sides of the converters 2*a* and 2*b*, and current detectors 12*a* and 12*b* are provided on the output sides of the inverters 3*a* and 3*b*. Current detectors 12*e* and 12*f* are provided on each terminal side of the capacitors 4*a* and 4*b*. The current detectors 12*a* to 12*f* output detect signals to control units 5*a* and 5*b*.

The control unit 5*a* controls the inverters 3*a* and 3*b*, and the control unit 5*b* controls the converters 2*a* and 2*b*. A communication unit 11 connects the controls units 5*a* and 5*b*, enabling them to exchange data.

In the constitution described above, when, for example, the inverter 3*a* has broken down, the elevator stops operating. The contactor 10*c* and the contactor 10*a* are switched off, cutting off the first power converter (i.e. the converter 2*a* and the inverter 3*a*) from the operating system, and power is supplied to the second winding by the second power converter (i.e. the converter 2*b* and the inverter 3*b*), thereby driving the wind-up mechanism 6 and enabling the passengers to be rescued.

As shown in FIGS. 10A and 10B, the two-winding motor constituting the wind-up mechanism 6 comprises a sheave 6, provided in the centers of two windings 6*a* and 6*b*. The windings 6*a* and 6*b* generate drive power in the manner of two independent motors, driving the sheave 6*c* and moving the main rope 9, which is connected to the carriage 8 and the counterweight 7. Therefore, when the wind-up mechanism 6 is activated by applying power to only one of the windings, the wind-up mechanism 6 vibrates; this may lead to a mechanical breakdown, such as damaging the bearings of the windings 6*a* and 6*b*.

In such a case, the elevator apparatus may be incapable of continuing the rescue operation, leaving the passengers trapped inside the carriage. Furthermore, when the elevator mechanism is damaged in this way, it cannot start operating again for a long time due to repairs; this problem has enormous implications in the elevator systems of ultra high-rise buildings.

SUMMARY OF THE INVENTION

The present invention has been realized after consideration of the circumstances described above, and aims to provide an elevator control device which, when there has been a breakdown in either one of first and second power converters supplying power to a multi-winding motor comprising a wind-up mechanism, can safely and reliably carry out a rescue operation using the remaining power converter.

To achieve the above objects, the elevator control device according to a first aspect of this invention comprises a wind-up mechanism, comprising a multi-winding motor having first and second windings provided on either side of a sheave; first and second power converters which supply power to the first and second windings respectively; a short-circuiting unit which short-circuits the output sides of the first and second power converters; and a control unit which, when one of the first and second power converters has broken down, stops the operation of the broken-down power converter, allows the short-circuiting unit to perform a short-circuit operation, and allows a rescue operation to be carried out to the wind-up mechanism by supplying power from the other power converter to the first and second windings.

According to a second aspect of this invention, in the elevator control device of the first aspect, input sides and output sides of the first and second power converters are connected to power, and to the first and second windings, via input side contactors and output side contactors respectively; and the control unit allows the short-circuiting unit to perform a short-circuit operation only in the case where the control unit has input an off-operation answer-back signal which shows that the input side contactor and the output side contactor, connected to the broken-down power converter, have switched off, and has input an on-operation answer-back signal which shows that the input side contactor and the output side contactor, connected to the healthy power converter, are switched on.

According to a third aspect of this invention, in the elevator control device of the first aspect, when executing the rescue operation to the wind-up mechanism by supplying power to the first and second windings from the other power converter, the control unit gives the acceleration and deceleration speeds predetermined values which are lower than those during normal operation.

According to a fourth aspect of this invention, in the elevator control device of the first aspect, the control unit inputs a carriage internal load detection value, and, when the load detection value is within a set range, sets the acceleration speed and, where necessary, the deceleration speed, to a first set value; when the load detection value is outside the set range, the control unit sets the acceleration speed and, where necessary, the deceleration speed, to a second set value which is smaller than the first set value.

According to a fifth aspect of this invention, in the elevator control device of the fourth aspect, when the load detection value is outside the set range, the control unit terminates the execution of the rescue operation instead of setting the acceleration speed and, where necessary, the deceleration speed, to the second set value.

PREFERRED EMBODIMENTS

Figure 9:
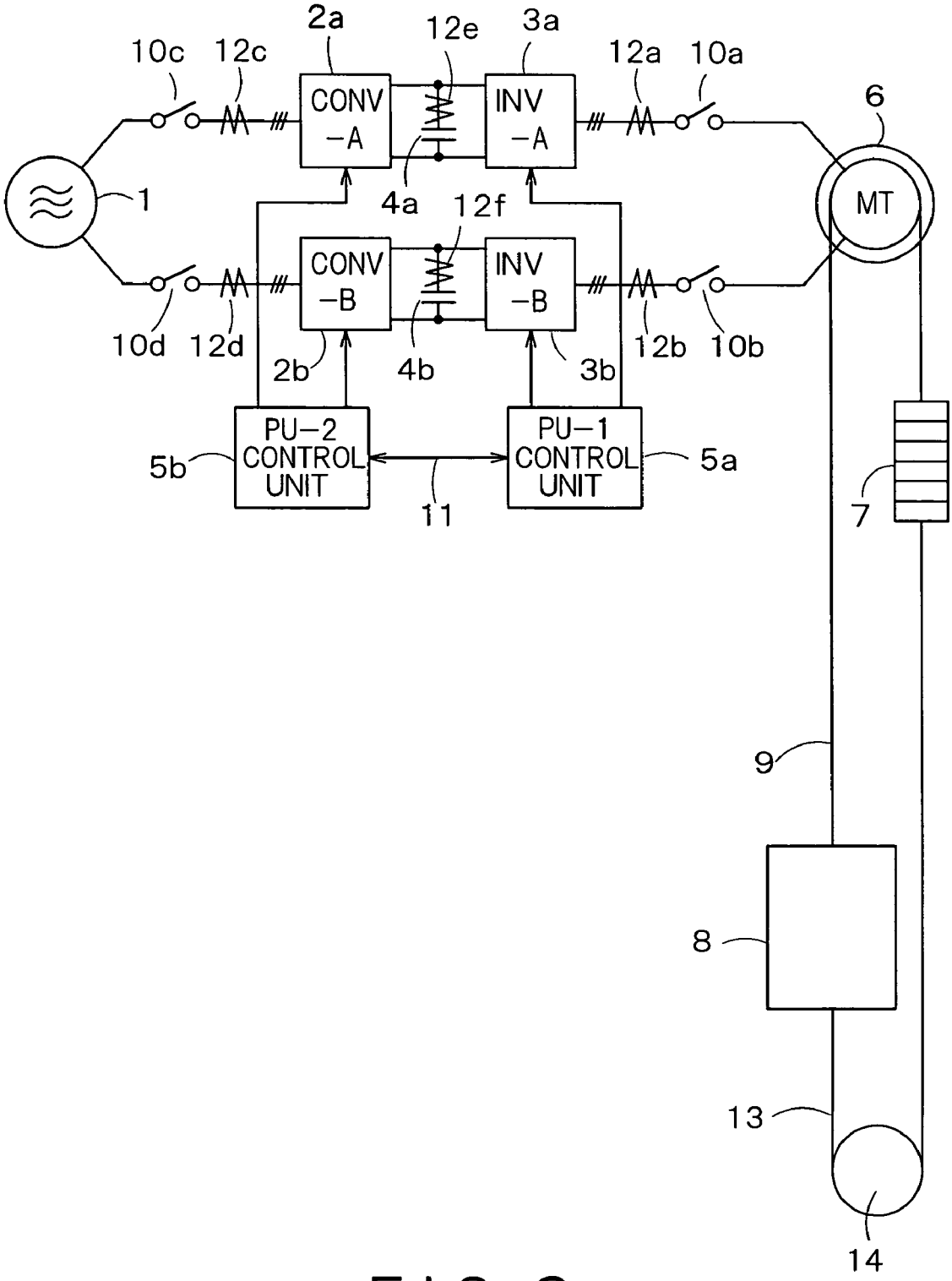
FIG. 9 is a diagram showing the constitution of a conventional elevator control device.
Figure 10A:
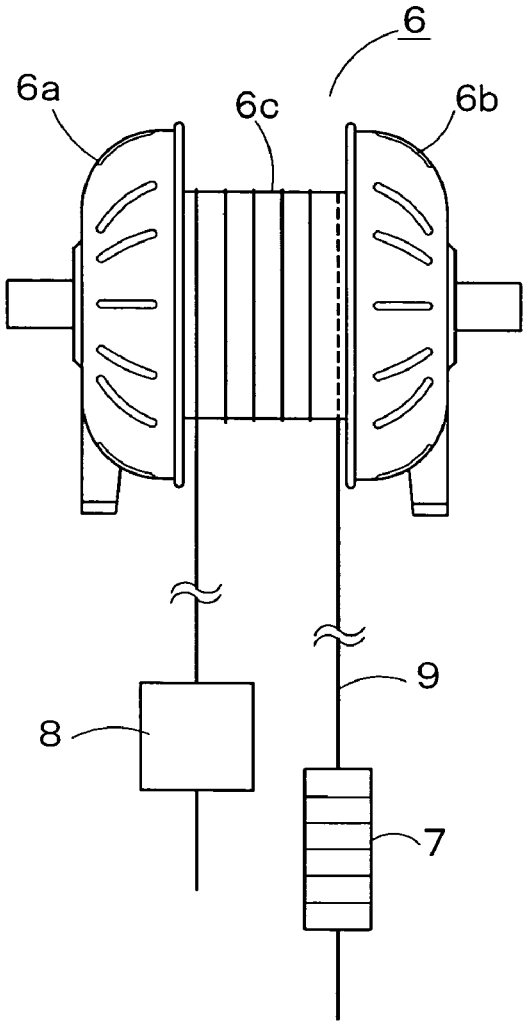
FIGS. 10A and 10B are diagrams showing the constitutions of a two-winding motor, and a carriage and counterweight, which are driven by the two-winding motor.
Figure 10B:
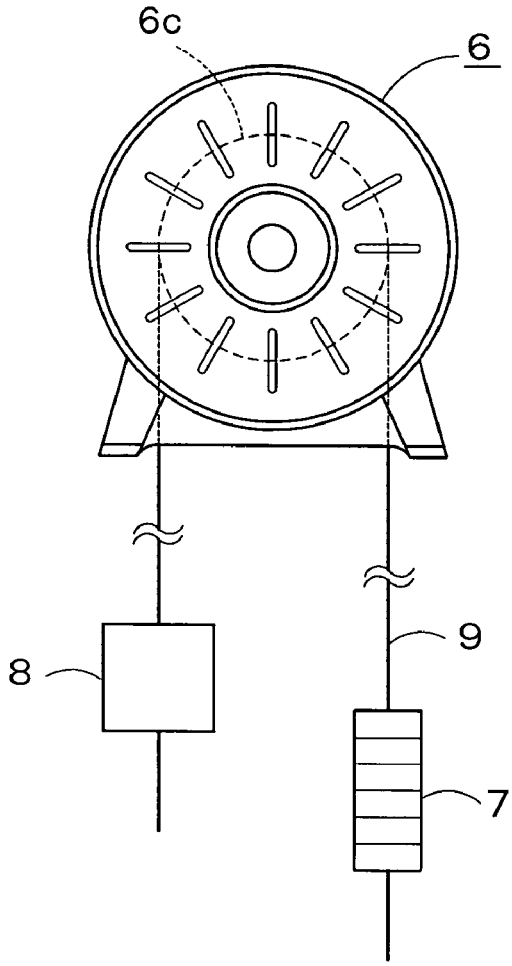

Embodiments of the present invention will be explained. Elements having the same constitution as those in FIGS. 9, 10A, and 10B, are represented by the same reference codes and are not explained further.

Figure 1:
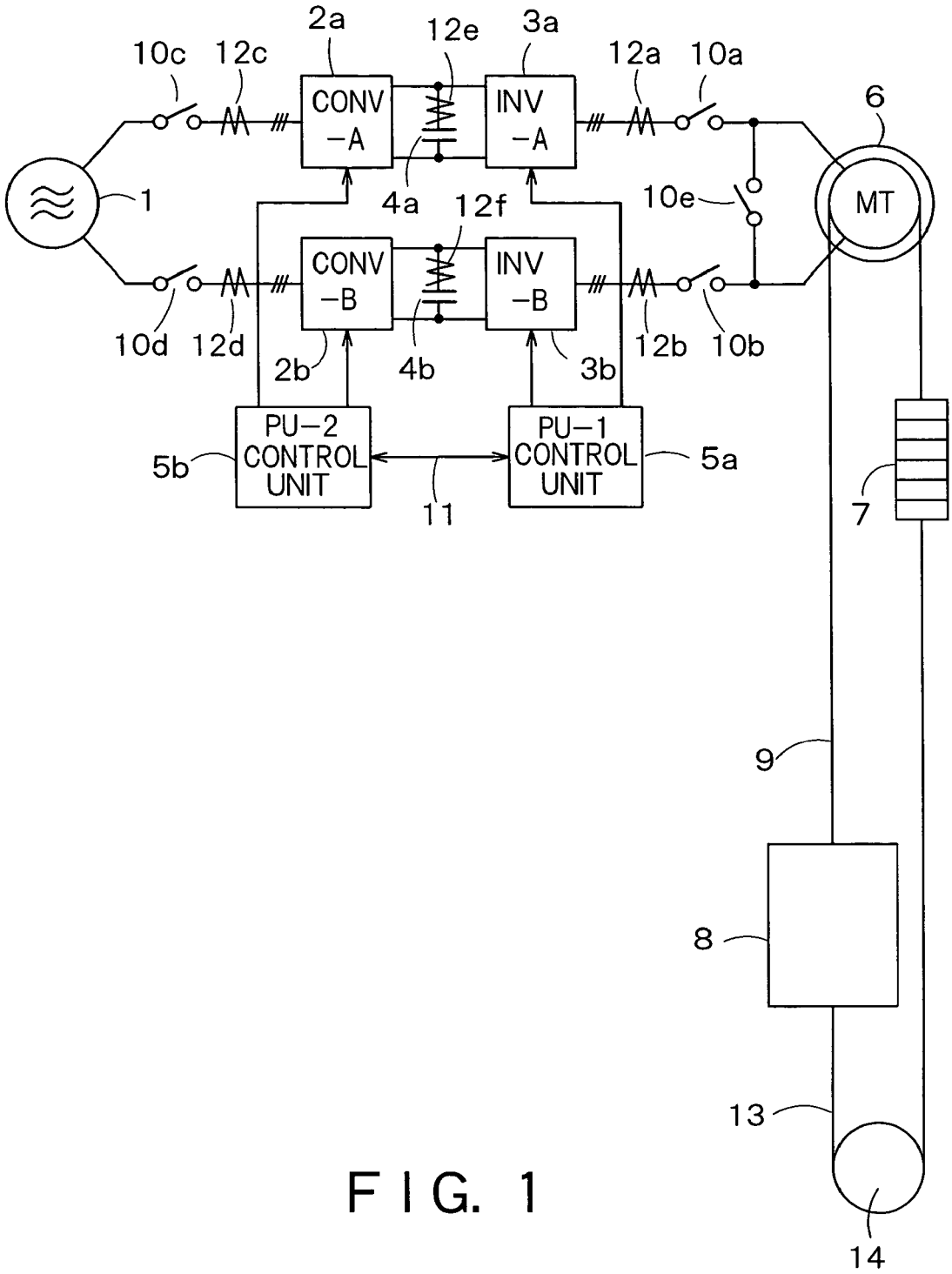
FIG. 1 is a diagram showing the constitution of a first embodiment of this invention.

FIG. 1 shows the constitution of a first embodiment of this invention. The constitution of FIG. 1 differs from that shown in FIG. 9 in that a contactor 10*e* is provided on the input side of the wind-up mechanism 6 (i.e. the output side of the inverters 3*a* and 3*b*) as a means of shortening the distance between the first and second windings. When the contactor 10*e* is switched on, power can be supplied to both windings from either one of the inverters.

For example, in the case where there is a system A comprising a first power converter and a system B comprising a second power converter, and the main circuit of system B is short-circuited to the motor of the wind-up mechanism 6 and connected to both windings, after system A has been cut off by switching off the contactors 10*c* and 10*a*, the contactor 10*e* is switched on, followed by the contactors 10*d* and 10*b*.

Conversely, when the main circuit of system A is short-circuited to the motor of the wind-up mechanism 6 and connected to both windings, after system B has been cut off by switching off the contactors 10*d* and 10*b*, the contactor 10*e* is switched on, followed by the contactors 10*c* and 10*a*.

Basically, in this embodiment, the control unit 5*a* controls the entire elevator, and the control unit 5*b* controls the converters 2*a* and 2*b* in compliance with commands from the control unit 5*a*. Furthermore, the control unit 5*a* controls the on/off operations of the contactors 10*a* to 10*d* and the contactor e.

Figure 2:
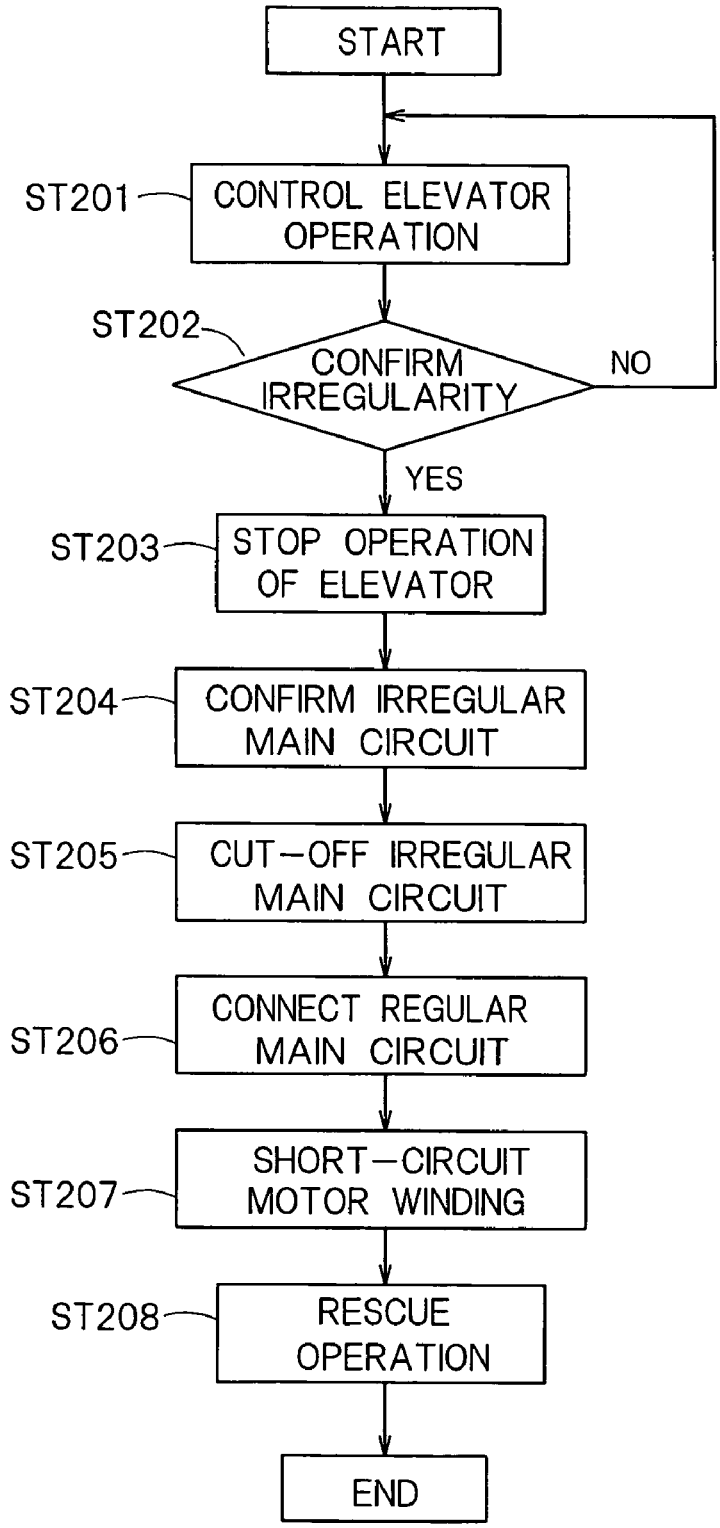
FIG. 2 is a flowchart showing the operation of the embodiment shown in FIG. 1.

Subsequently, the operation of the embodiment shown in FIG. 1 will be explained based on the flowchart of FIG. 2. The following example describes a rescue operation when the elevator has stopped after the inverter 3*a* has broken down due to excessive current.

From START the operation proceeds to step 201, where the upward and downward motion of the elevator is controlled. Next, in step 202, irregularity of the main circuit is confirmed. When no irregularity is confirmed, the operation returns to step 201 and the elevator continues to operate. When an irregularity has been detected, the operation proceeds to step 203. In step 203, the operation of the elevator is stopped. In step 204, the main circuit where the irregularity occurred is confirmed.

As mentioned above, this example describes a breakdown of the inverter 3*a* due to excessive current. In step 205, the inverter 3*a* (the irregular main circuit) is cut-off. That is, the control unit 5*a* switches off the contactors 10*a* and 10*c*, cutting off the main circuit of system A from the power 1 and the wind-up mechanism 6.

Next, in step 206, a regular inverter is connected. The control unit 5*a* switches on the contactors 10*b* and 10*d*, connects the converter 2*b* to the power 1, and connects the inverter 3*b* (the regular inverter) to the motor of the wind-up mechanism 6. In step 207, the control unit 5*a* switches on the contactor 10*e*, short-circuiting the first and second windings of the wind-up mechanism 6 and enabling the output of the inverter 2*b* to be supplied to both windings. Thereafter, in step 208, the elevator is activated and a rescue operation is carried out by delivering the carriage 8 to the rescue floor and releasing the passengers from the carriage 8 before terminating all operations.

In this way, in the first embodiment, the output of the regular inverter is supplied to all the windings of the multi-winding motor, enabling the motor to be stably rotated even when one of the inverters has broken down. This makes it possible to prevent the mechanism of the wind-up mechanism 6 from breaking down, and enables the elevator rescue operation to be safely and correctly executed when a main circuit has broken down.

Figure 3:
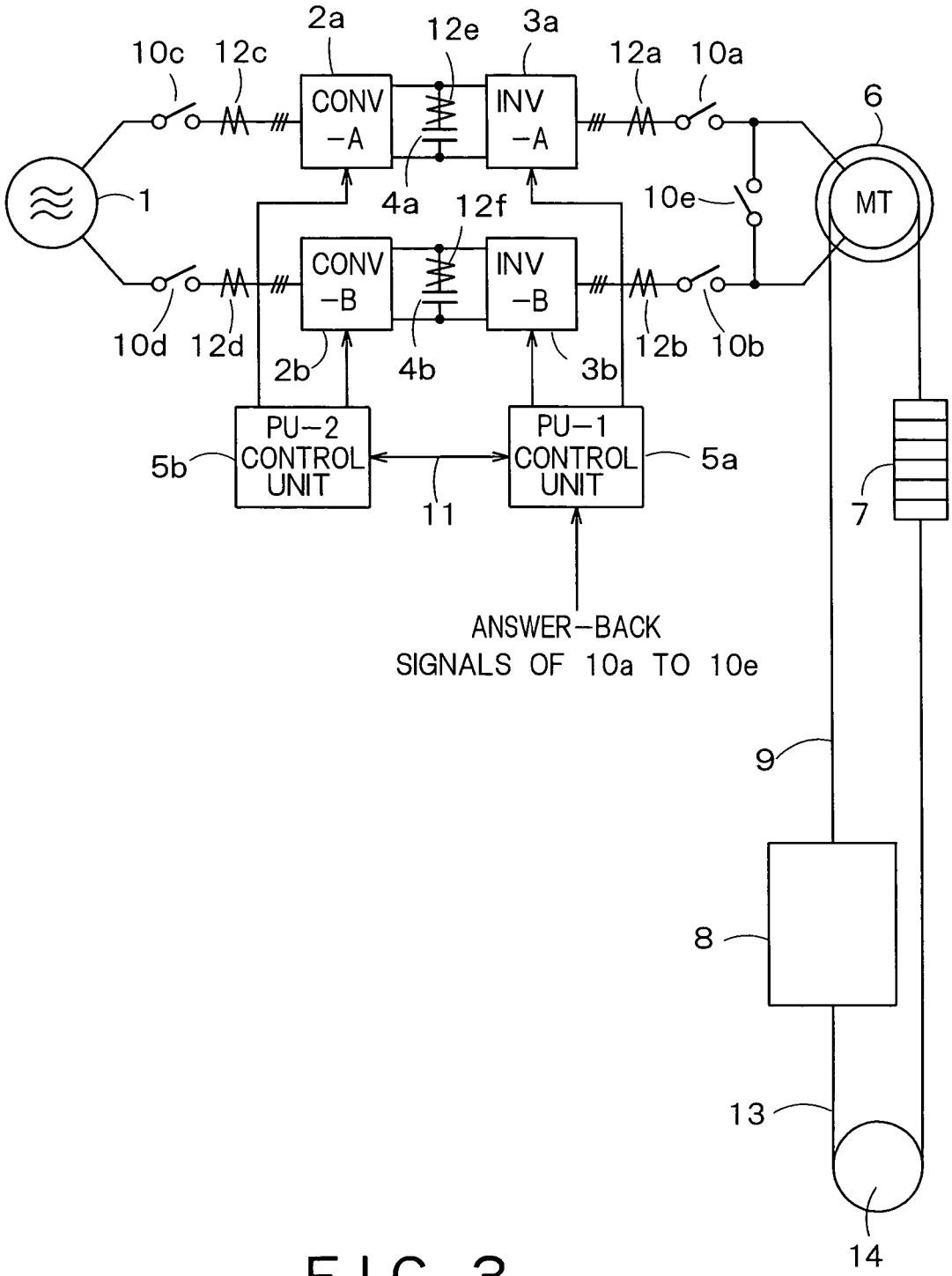
FIG. 3 is a diagram showing the constitution of a second embodiment of this invention.

FIG. 3 shows the constitution of a second embodiment of this invention. The constitution of FIG. 3 differs from that shown in FIG. 1 in that the control unit 5*a* inputs an answer-back signal, which show that the contact point has reliably turned on or off, from the contactors 10*a* to 10*e*.

Figure 4:
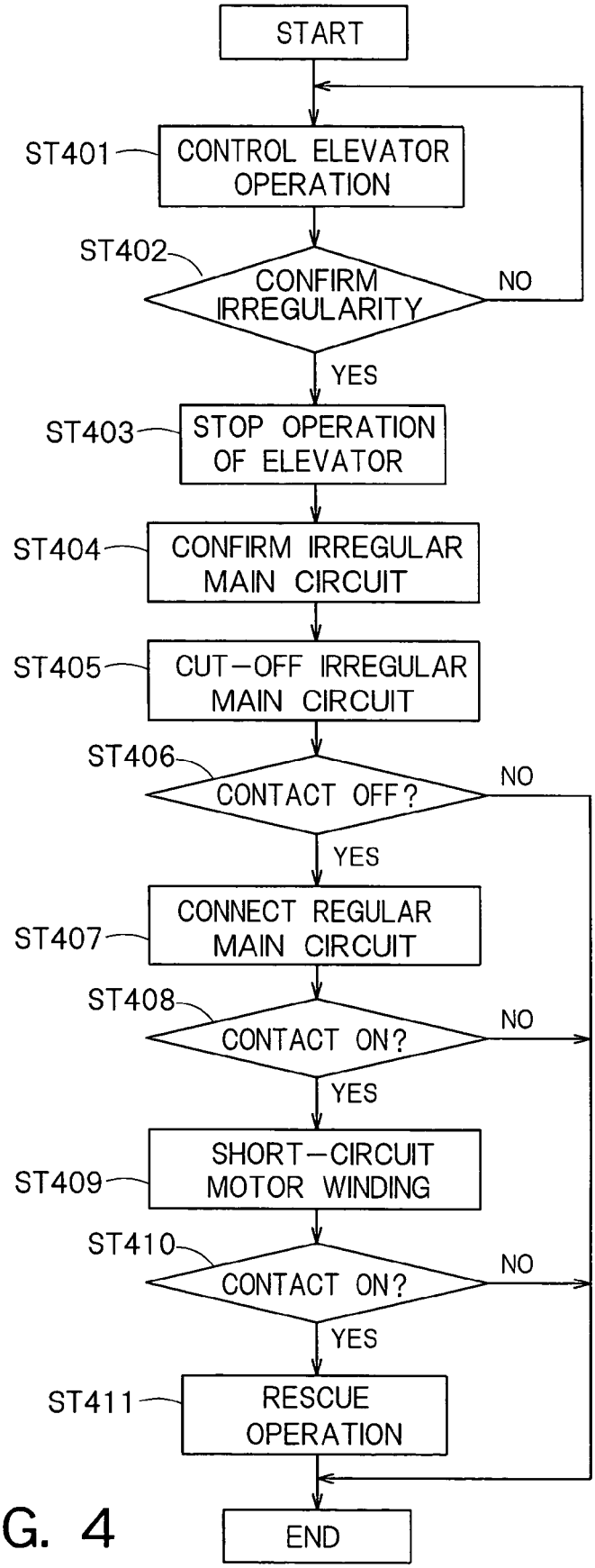
FIG. 4 is a flowchart showing the operation of the embodiment shown in FIG. 3.

The operation of the embodiment shown in FIG. 3 will be explained based on the flowchart of FIG. 4. In step 401, the upward and downward motion of the elevator is controlled. Next, in step 402, irregularity of the main circuit is confirmed. When no irregularity is confirmed, the operation returns to step 401 and the elevator continues to operate. When an irregularity has been detected, the operation proceeds to step 403. In step 403, the operation of the elevator is stopped. In step 404, the main circuit where the irregularity occurred is confirmed. As in the previous example, this example describes a breakdown of the inverter 3*a* due to excessive current.

In step 405, the inverter 3*a* (the irregular main circuit) is cut-off. That is, the control unit 5*a* switches off the contactors 10*a* and 10*c*, cutting off the main circuit of system A from the power 1 and the wind-up mechanism 6. In step 406, it is determined whether an off-operation answer-back signal, which shows that the contactors 10*a* and 10*c* have been switched off, has been input; when the off-operation answer-back signal has been input, the operation proceeds to step 407. When the off-operation answer-back signal cannot be confirmed, there is a danger that the contact points may have become welded; in such a case, continuing the operation may further damage the device, and for this reason the operation is terminated without carrying out the rescue operation.

In step 407, a regular inverter is connected. The control unit 5*a* switches on the contactors 10*b* and 10*d*, connects the converter 2*b* to the power 1, and connects the inverter 3*b* (the regular inverter) to the motor of the wind-up mechanism 6. In step 408, it is determined whether an on-operation answer-back signal, which shows that the contactors 10*b* and 10*d* have been switched on, has been input; when the on-operation answer-back signal has been input, the operation proceeds to step 409. When the on-operation answer-back signal cannot be confirmed, since current cannot be transmitted to the windings of the wind-up mechanism 6, the operation is terminated without carrying out a rescue operation.

In step 409, the control unit 5*a* switches on the contactor 10*e*, short-circuiting the first and second windings of the wind-up mechanism 6 and enabling the output of the inverter 2*b* to be supplied to both windings. In step 410, it is determined whether an on-operation answer-back signal, which shows that the contactor 10*e* has been switched on, has been input; when the on-operation answer-back signal has been input, the operation proceeds to step 411. When the on-operation answer-back signal cannot be confirmed, since power cannot be supplied from the inverter 3*b* to the first winding A, the operation is terminated without carrying out the rescue operation.

Thereafter, in step 411, the elevator is activated and the rescue operation is carried out by delivering the carriage 8 to the rescue floor and releasing the passengers from the carriage 8 before terminating all operations.

In this way, according to the second embodiment, answer-back signals from the contactors are used to terminate the rescue operation when the main circuit cannot be cut-off or connected due to an irregularity in the contactors, when power cannot be supplied to the motor, and when there is a danger of damaging the apparatus if current were to be supplied. Therefore, in addition to the advantages of the first embodiment, the second embodiment can prevent secondary mechanical damage.

When the motor is driven after short-circuiting the windings, executing the same controls as in normal operation places a greater load on the inverters than in normal operation. For example, when the motor is driven at the same speed as in normal operation, the output current of the inverter is, simply calculated, twice the normal current. During upward operation of the elevator, for example, the motor torque is generally expressed by the following equations (1) to (4).

$$\text{steady-state upward torque}=(\text{carrying mass}+\text{carriage mass}+\text{main rope mass}-\text{counterweight mass}-\text{compen-mass})\times\text{sheave diameter}/2\times\text{machine efficiency} \quad (1)$$

$$\text{upward acceleration torque}=\text{acceleration}/19.6\times\text{sheave diameter}\times(\text{sheave } GD2)+\text{steady-state upward torque} \quad (2)$$

$$\text{upward deceleration torque}=\text{deceleration}/19.6\times\text{sheave diameter}\times(\text{sheave } GD2)+\text{steady-state upward torque} \quad (3)$$

$$\text{current}=\sqrt{(q \text{ axis current}\times\text{axis load torque}/\text{rated torque}+\text{axis current})} \quad (4)$$

As is clear from the above equations, while the elevator is operating, all values other than acceleration and deceleration are fixed. Consequently, the motor torque and motor current can be reduced by reducing at least one of the acceleration and deceleration speeds.

Figure 5:
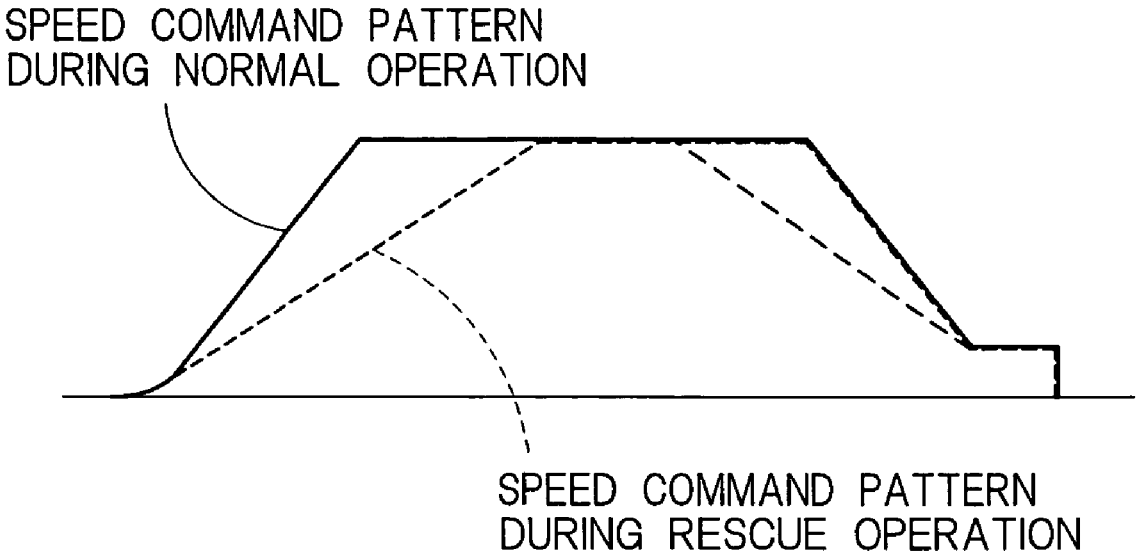
FIG. 5 is a characteristics diagram showing the operating pattern when performing a rescue operation in the embodiments of this invention.

FIG. 5 shows an example of an operating pattern during a rescue operation. The solid line represents the operating pattern during normal operation, and the broken line represents the operating pattern during the rescue operation. The patterns differ in strenuous mode and regenerative mode; this example shows the case of maximum carrying mass. In regenerative mode during the rescue operation, there are two patterns: a pattern which decelerates abruptly in the same manner as strenuous mode, and a pattern which decelerates more gradually; one of these patterns is selected.

As shown in equation (2) for the upward acceleration torque, upward operation is executed in the strenuous mode, and the steady-state upward torque is positive; therefore, the value of the first item can be reduced by reducing the acceleration speed, enabling the required torque to be reduced.

As shown in equation (3) for the upward deceleration torque, since the steady-state upward torque is negative, no problems arise when the deceleration is the same as during normal operation. Conversely, in regenerative mode, the required torque can be reduced by keeping the acceleration in the same direction as during normal operation and reducing the deceleration to below that of normal operation.

In this way, when performing the rescue operation, by reducing the acceleration and deceleration to values lower than during normal operation, the current during acceleration and deceleration can be controlled, reducing the load on the inverters and enabling the rescue operation to be reliably carried out.

Figure 6:
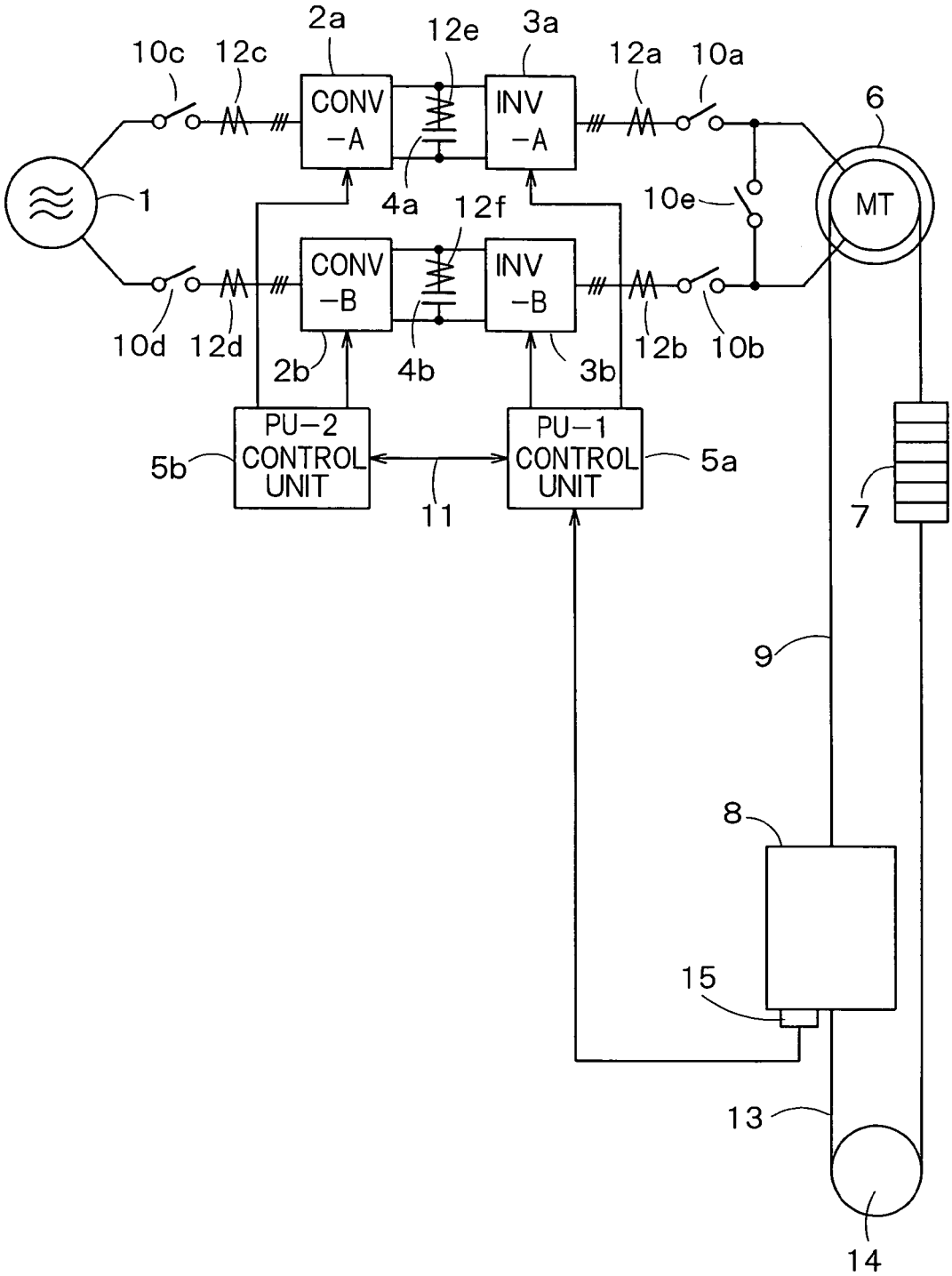
FIG. 6 is a diagram showing the constitution of a third embodiment of this invention.

FIG. 6 shows the constitution of a third embodiment of this invention. FIG. 6 differs from FIG. 1 in that a load detector 15 is attached to the carriage 8, and inputs a load detect signal to the control unit 5*a*. Generally, the load on the inverter differs according to the number of passengers in the carriage 8 when the elevator breaks down.

In a well rope-system elevator, the closer the mass of the counterweight 7 to the mass of the carriage 8, the smaller the required torque, and consequently, the smaller the load on the inverter. On the other hand, when the elevator moves upward at full passenger capacity, or when the elevator moves downward with no passengers on board, maximum output is required of the inverter. Circumstances differ in strenuous mode and regenerative mode.

Figure 7:
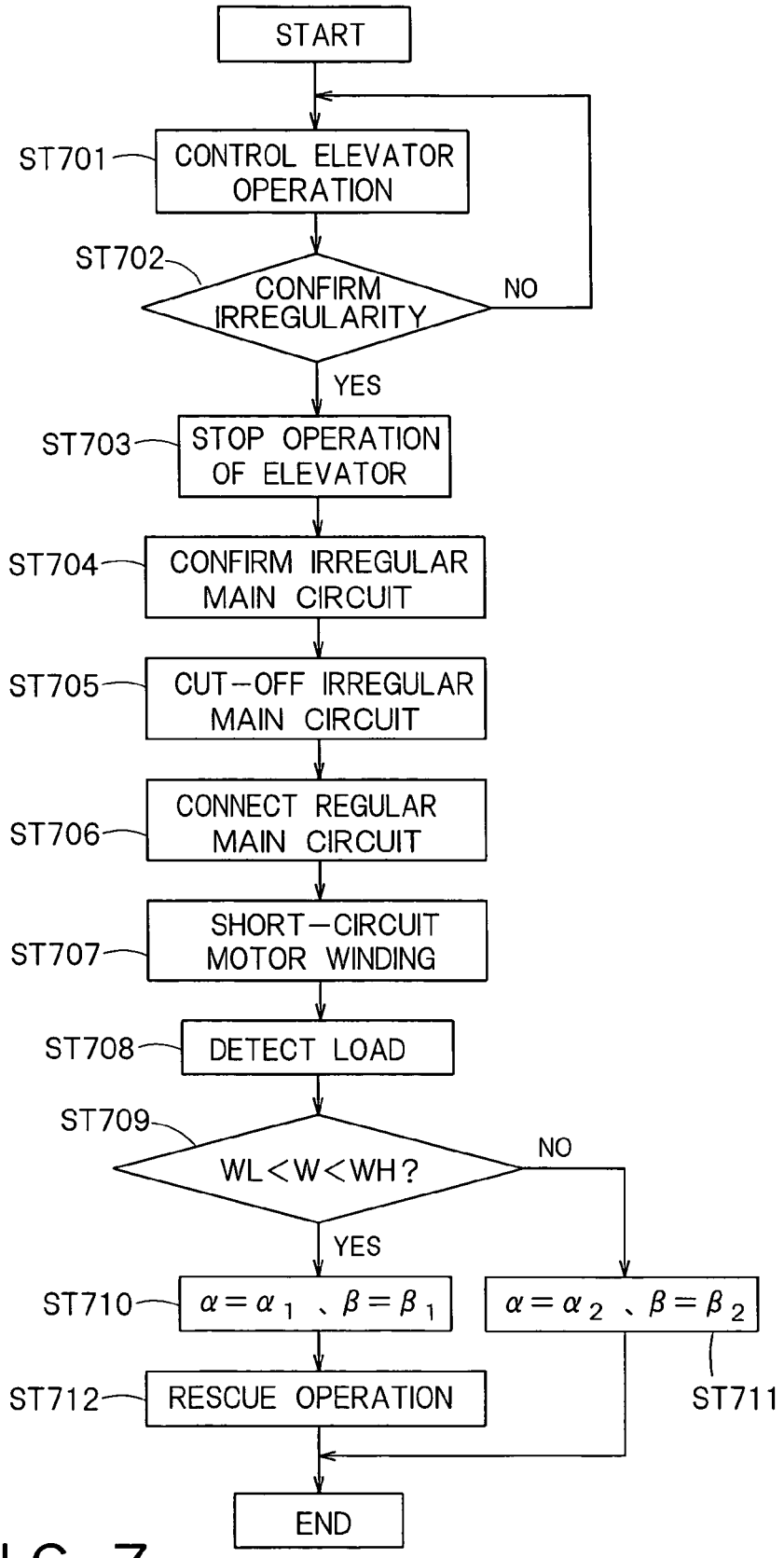
FIG. 7 is a flowchart showing the operation of the embodiment shown in FIG. 6.

Subsequently, the operation of the embodiment shown in FIG. 6 will be explained based on the flowchart of FIG. 7. From START the operation proceeds to step 701, where the upward and downward motion of the elevator is controlled. Next, in step 702, irregularity of the main circuit is confirmed. When no irregularity is confirmed, the operation returns to step 701 and the elevator continues to operate. When an irregularity has been detected, the operation proceeds to step 703. In step 703, the operation of the elevator is stopped. In step 704, the main circuit where the irregularity occurred is confirmed.

As mentioned above, this example describes a breakdown of the inverter 3*a* due to excessive current. In step 705, the inverter 3*a* (the irregular main circuit) is cut-off. That is, the control unit 5*a* switches off the contactors 10*a* and 10*c*, cutting off the main circuit of system A from the power 1 and the wind-up mechanism 6.

Next, in step 706, a regular inverter is connected. The control unit 5*a* switches on the contactors 10*b* and 10*d*, connects the converter 2*b* to the power 1, and connects the inverter 3*b* (the regular inverter) to the motor of the wind-up mechanism 6. In step 707, the control unit 5*a* switches on the contactor 10*e*, short-circuiting the first and second windings of the wind-up mechanism 6 and enabling the output of the inverter 2*b* to be supplied to both windings.

In step 708, the load detector 15 detects the load in the carriage 8, and in step 709, it is determined whether or not the detected value W is between an upper limit WH and a lower limit WL. When the detected value W is between the upper and lower limits, the operation proceeds to step 710, β in which the elevator is driven with acceleration α at α1 and deceleration β at β1; when the detected value W is outside the upper and lower limits, the operation proceeds to step 711, in which the elevator is driven with acceleration α at α2 and deceleration β at β2. When the acceleration and deceleration during normal operation are expresses as αn and βn, the relationship between them is $$\alpha n \geqq \alpha 1 > \alpha 2,\ \beta n \geqq \beta 1 > \beta 2$$

Next, in step 712, the elevator is activated and a rescue operation is carried out by delivering the carriage 8 to the rescue floor and releasing the passengers from the carriage 8 before terminating all operations.

In this way, in the third embodiment, acceleration and deceleration speeds are determined in accordance with the load status during the rescue operation. Therefore, when the elevator is capable of operating at high acceleration, it can move more speedily to the rescue point and relieve the anxiety of the passengers; when it has been determined that the load is great and the elevator cannot accelerate speedily, the acceleration current is reduced, reducing the load on the inverter and enabling the rescue operation to be reliably carried out.

Subsequently, a fourth embodiment of this invention will be explained. Since the constitution of the fourth embodiment is the same as the third embodiment shown in FIG. 6, it is not illustrated in the drawings. This embodiment differs from the third embodiment in that, when the detected value of the carriage load is outside a predetermined range, it is deemed that the wind-up mechanism 6 cannot be driven even at maximum inverter output, and the rescue operation is terminated.

Figure 8:
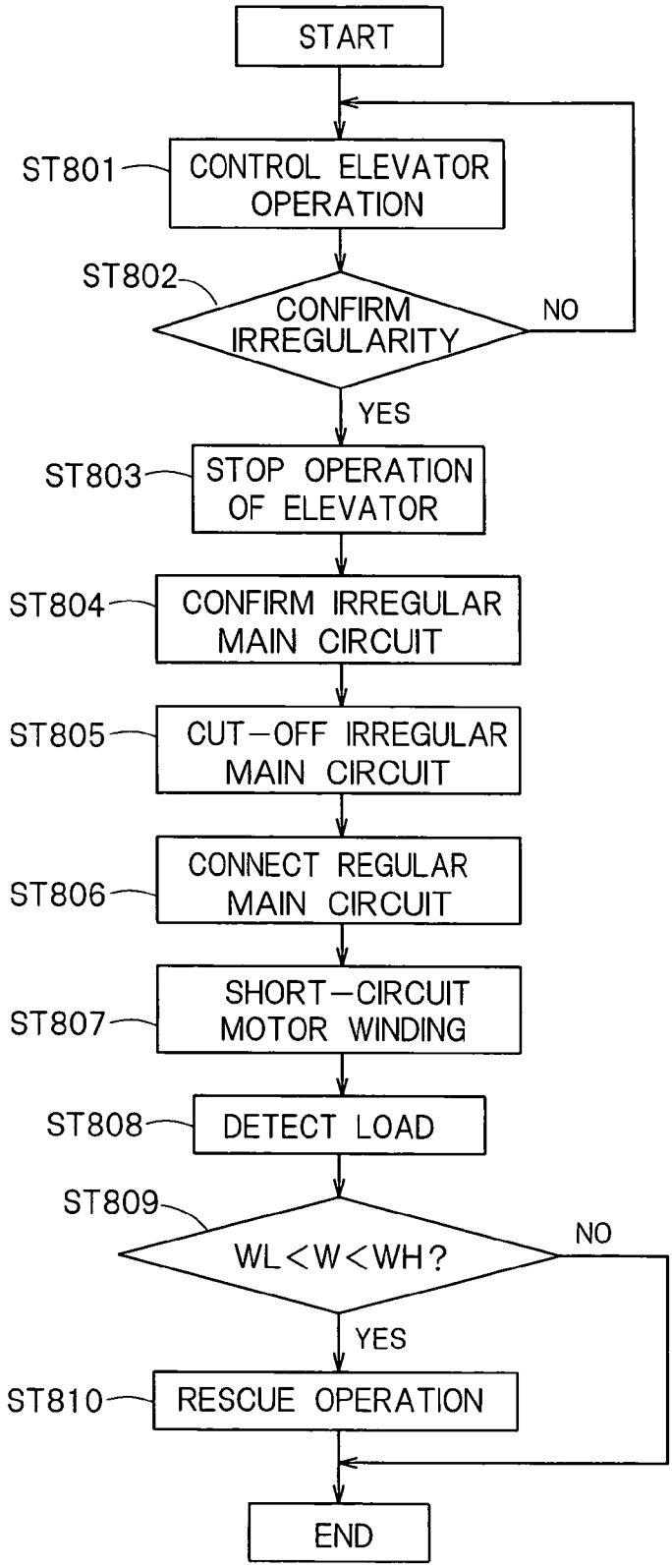
FIG. 8 is a flowchart showing the operation of a fourth embodiment of this invention.

FIG. 8 shows a flowchart of the operation of the fourth embodiment. Steps 801 to 809 are identical to steps 701 to 709 of FIG. 7, and will not be explained further. In the determination of step 809, when the formula WL<W<WH is satisfied, the operation proceeds to step 810, in which the elevator is activated and the rescue operation is carried out by delivering the carriage 8 to the rescue floor and releasing the passengers from the carriage 8 before terminating all operations. On the other hand, when WL<W<WH is not satisfied, all operations end without carrying out the rescue operation.

According to the fourth embodiment, when it has been determined that the carriage 8 cannot be driven even at maximum inverter output, the rescue operation is terminated, thereby preventing secondary mechanical damage.

Although the above embodiments describe a case where the multi-winding motor forming the wind-up mechanism 6 comprises a two-winding motor (in this case, there is one first winding and one second winding), the present invention is applicable in an N-winding motor (where N=an even number such as 2, 4, 6, . . . , there being N/2 first windings and N/2 second windings).

As described above, according to this invention, when there has been a breakdown in either one of first and second power converters supplying power to a multi-winding motor comprising a wind-up mechanism, a rescue operation can be safely and reliably carried out by using the remaining power converter.

What is claimed is:

1. An elevator control device comprising:

a wind-up mechanism, comprising a multi-winding motor having first and second windings provided on either side of a sheave;

first and second power converters which supply power to the first and second windings respectively;

a short-circuiting unit which short-circuits the output sides of the first and second power converters; and a control unit which, when one of the first and second power converters has broken down, stops the operation of the broken-down power converter, allows the short-circuiting unit to perform a short-circuit operation, and allows a rescue operation to be carried out to the wind-up mechanism by supplying power from the other power converter to the first and second windings.

2. The elevator control device as described in claim 1, wherein input sides and output sides of the first and second power converters are connected to power, and to the first and second windings, via input side contactors and output side contactors respectively; and the control unit allows the short-circuiting unit to perform a short-circuit operation only in the case where the control unit has input an off-operation answer-back signal which shows that the input side contactor and the output side contactor, connected to the broken-down power converter, have switched off, and has input an on-operation answer-back signal which shows that the input side contactor and the output side contactor, connected to the healthy power converter, are switched on.

3. The elevator control device as described in claim 1, wherein, when executing the rescue operation to the wind-up mechanism by supplying power to the first and second windings from the other power converter, the control unit gives the acceleration and deceleration speeds predetermined values which are lower than those during normal operation.

4. The elevator control device as described in claim 1, wherein the control unit inputs a carriage internal load detection value, and, when the load detection value is within a set range, sets the acceleration speed and, where necessary, the deceleration speed, to a first set value; when the load detection value is outside the set range, the control unit sets the acceleration speed and, where necessary, the deceleration speed, to a second set value which is smaller than the first set value.

5. The elevator control device as described in claim 4, wherein, when the load detection value is outside the set range, the control unit terminates the execution of the rescue operation instead of setting the acceleration speed and, where necessary, the deceleration speed, to the second set value.

* * * * *